US006901708B1

(12) United States Patent
Powers, III

(10) Patent No.: US 6,901,708 B1
(45) Date of Patent: Jun. 7, 2005

(54) BUILDING SYSTEM

(76) Inventor: John Powers, III, 6641 S. 38th St., Phoenix, AZ (US) 85040

( * ) Notice: Subject to any disclaimer, the term of this patent is extended or adjusted under 35 U.S.C. 154(b) by 70 days.

(21) Appl. No.: 10/418,016

(22) Filed: Apr. 17, 2003

(51) Int. Cl.[7] ..... E04B 7/00
(52) U.S. Cl. ..... 52/91.1; 52/91.3; 52/86
(58) Field of Search ..... 52/91.1, 91.3, 52/86, 630, 631, 79.1

(56) References Cited

U.S. PATENT DOCUMENTS 1,883,141 A * 10/1932 Walthers ..... 52/463
2,023,814 A * 12/1935 Lindsey ..... 52/91.3
2,051,707 A * 8/1936 Harrison ..... 52/731.7
2,180,317 A * 11/1939 Davis ..... 52/319
2,328,197 A * 8/1943 Cowin ..... 52/86
2,647,475 A * 8/1953 Dietrich ..... 52/86
2,933,056 A * 4/1960 Martin ..... 52/86
3,127,960 A * 4/1964 Smith et al. ..... 52/222
3,260,022 A * 7/1966 Reynolds et al. ..... 52/86
3,747,290 A * 7/1973 Barrell et al. ..... 52/91.1
3,755,975 A * 9/1973 Herzer et al. ..... 52/90.1
3,854,248 A * 12/1974 Dayus ..... 49/504
3,883,999 A * 5/1975 Nicoll, Jr. ..... 52/91.1
3,902,288 A * 9/1975 Knudson ..... 52/86
4,291,510 A * 9/1981 Sivachenko ..... 52/91.3
4,616,453 A * 10/1986 Sheppard et al. ..... 52/93.1
5,274,974 A * 1/1994 Haag ..... 52/300
5,295,335 A * 3/1994 Collier ..... 52/86
5,425,212 A * 6/1995 Menchetti ..... 52/731.7
5,509,242 A * 4/1996 Rechsteiner et al. ..... 52/270
5,720,577 A * 2/1998 Sanders et al. ..... 405/124

FOREIGN PATENT DOCUMENTS

FR 701339 * 10/1930 ..... 52 86

* cited by examiner

*Primary Examiner*—Robert Canfield
(74) *Attorney, Agent, or Firm*—Parsons & Goltry; Robert A. Parsons; Michael W. Goltry

(57) ABSTRACT

A small building assembled using a building system includes a plurality of elongated building elements each having a roof portion and two opposed sidewall portions extending longitudinally from opposite sides of the roof portion. The roof portion and sidewall portions of each building element are integrally formed and attached, and the roof portion and sidewall portions of each building element define a longitudinally and laterally extending flat surface between flanges extending along opposed edges of the roof portion and sidewall portions. Each of the plurality of elongated building elements are placed adjacent another of the plurality of elongated building elements with adjacent flanges abutting and fixedly engaged together at spaced apart points to form an extended roof and sidewalls.

17 Claims, 6 Drawing Sheets

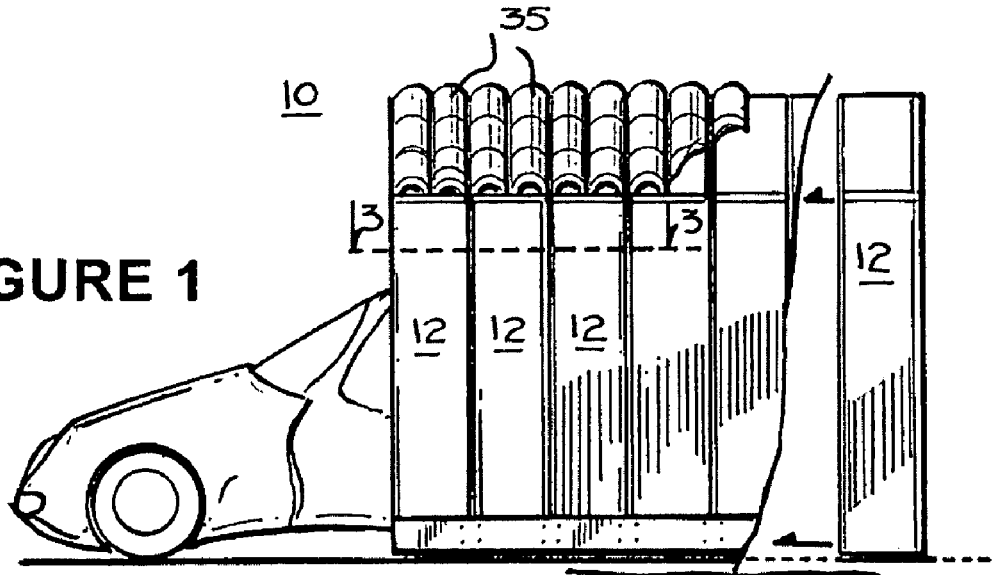
FIGURE 1
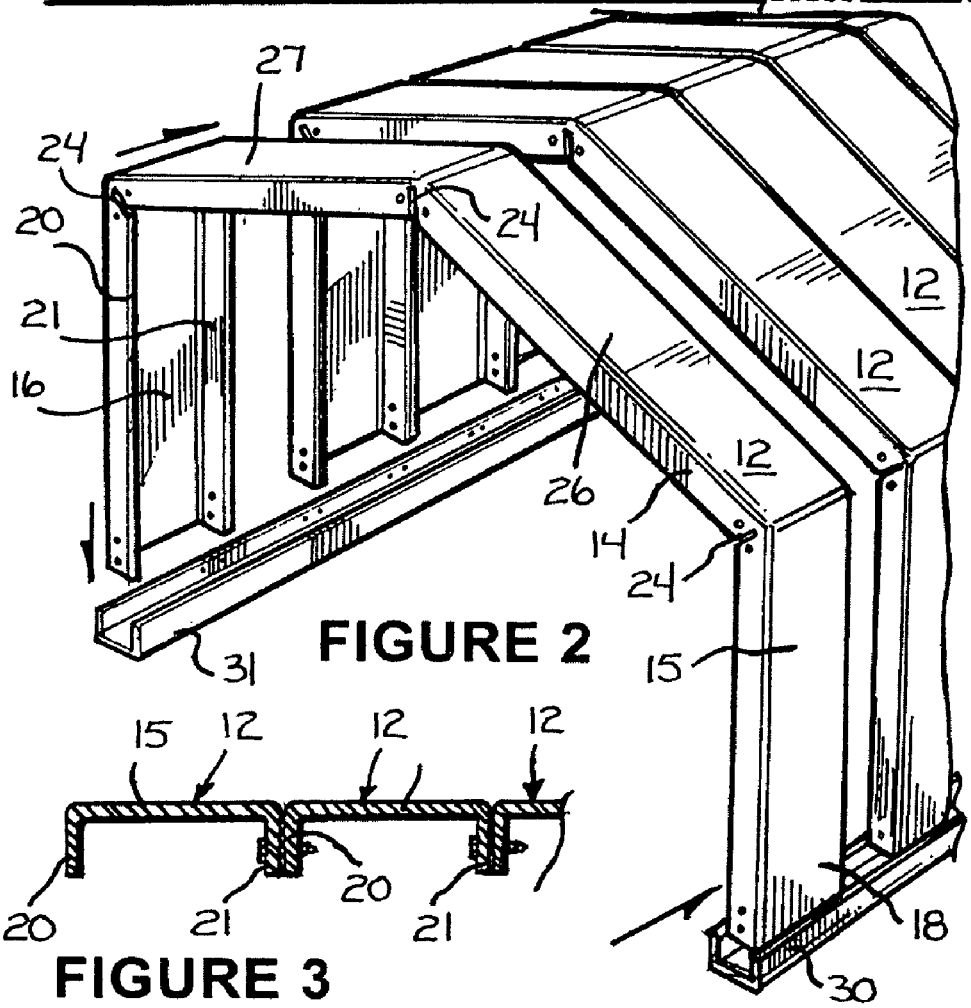
FIGURE 2
FIGURE 3

FIGURE 5
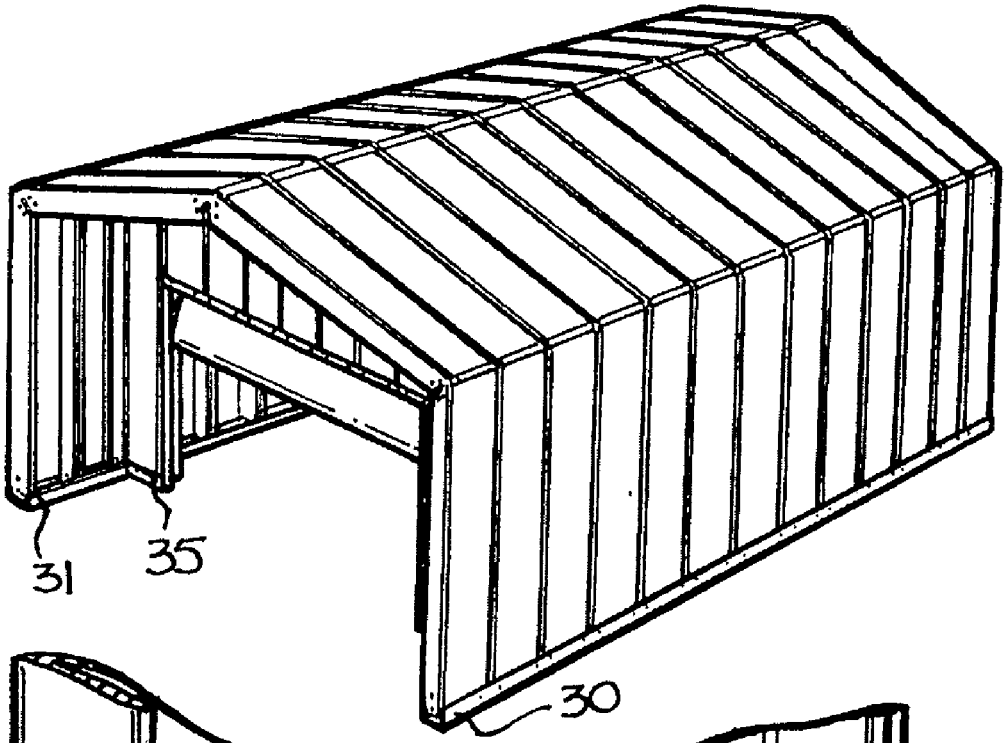
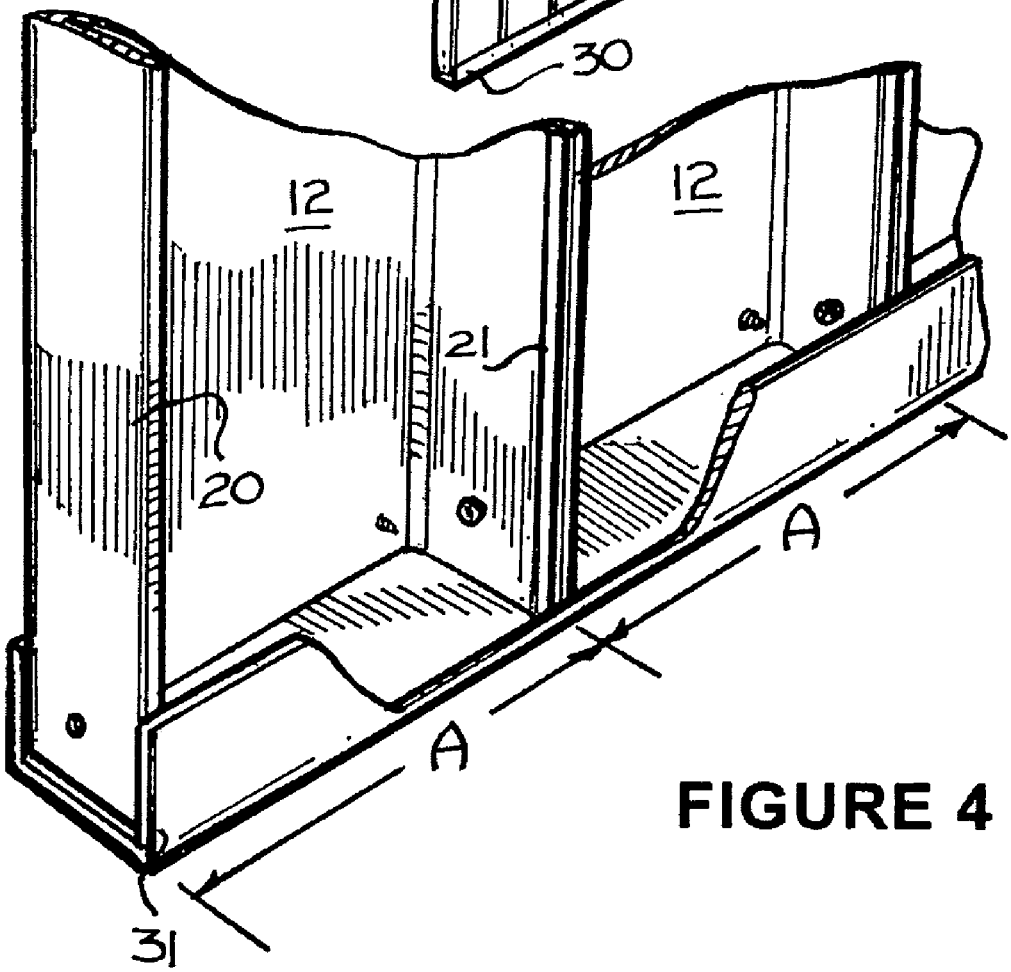
FIGURE 4

FIGURE 6
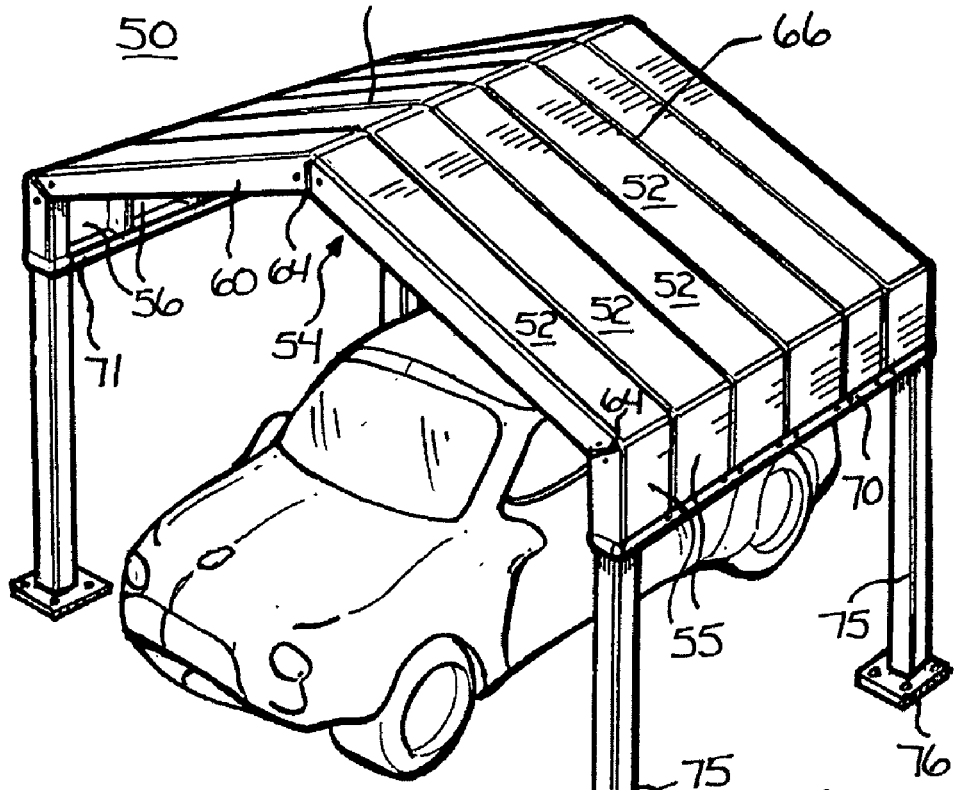
FIGURE 7
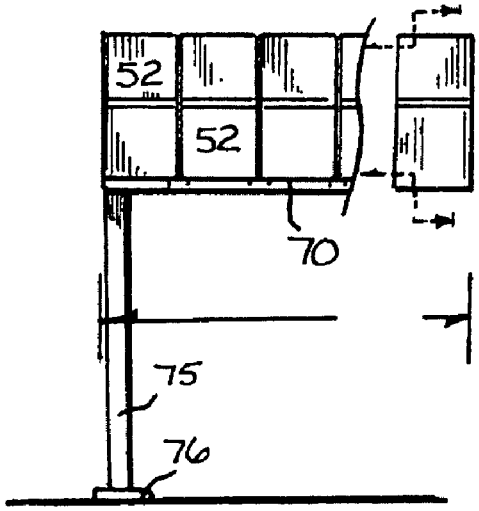
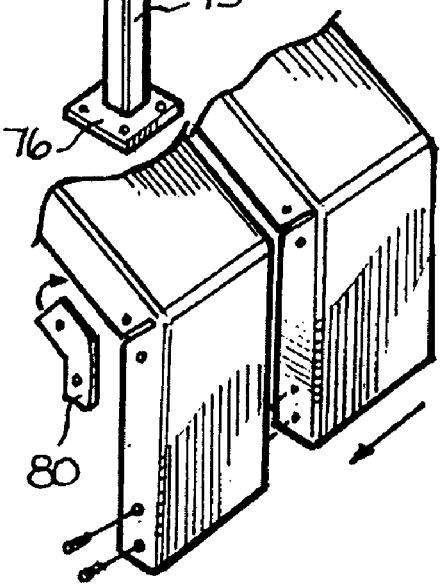
FIGURE 8

FIGURE 11
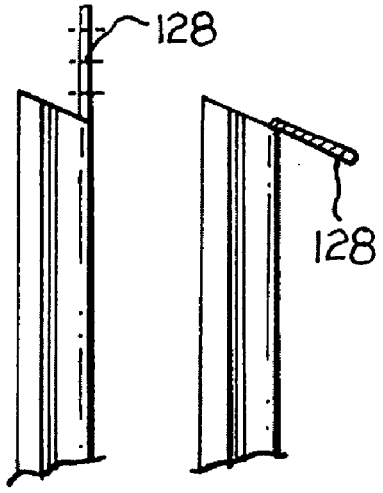
FIGURE 12
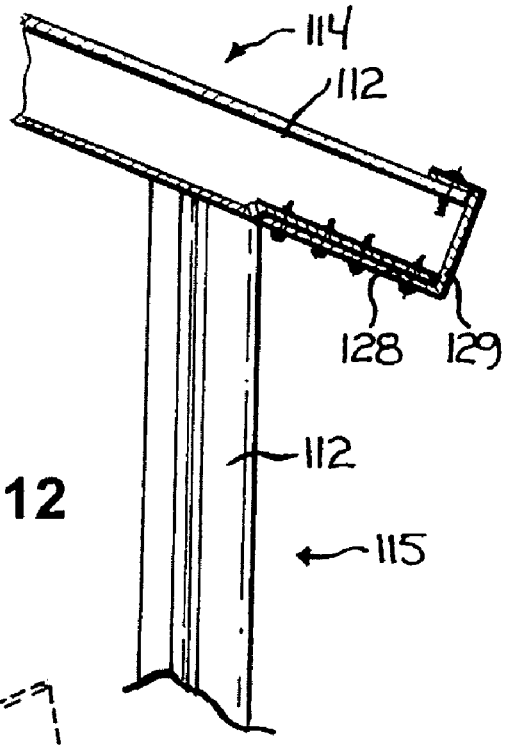
FIGURE 14
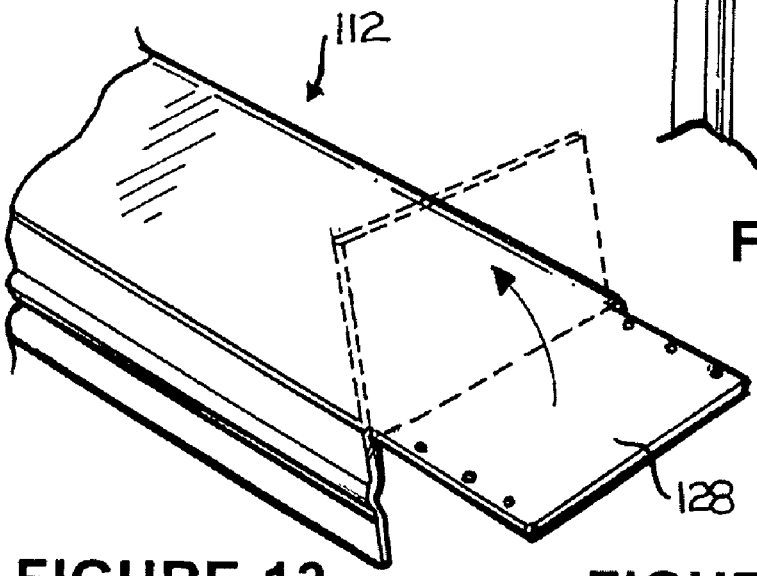
FIGURE 13
FIGURE 16
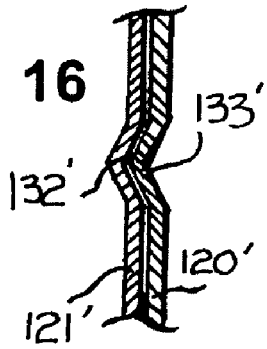
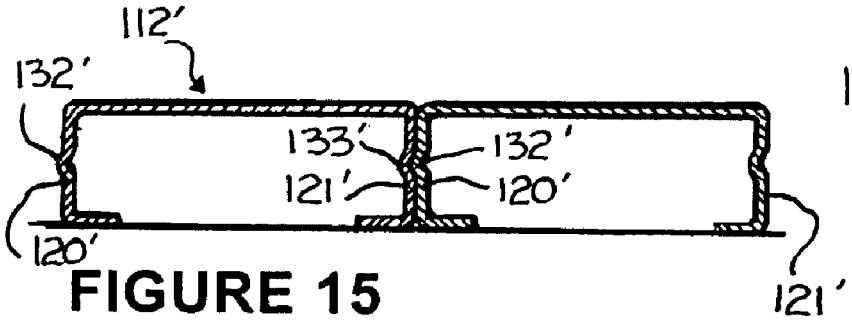
FIGURE 15

BUILDING SYSTEM

FIELD OF THE INVENTION

This invention relates to small buildings, such as garages, carports or canopies, storage sheds and the like.

More particularly, the present invention relates to easily assembled small buildings.

BACKGROUND OF THE INVENTION

At the present time small buildings placed about a person's property are very popular. Generally, it is preferred that these small buildings are free standing and situated at some distance from the main building or buildings. These small buildings may have a multitude of different purposes, such as completely or partially enclosed garages for single cars or other vehicles, carports or canopies, storage sheds and the like.

Some small buildings are presently available on the commercial market but they all have several drawbacks that severely limit their adaptability to different uses and situations. Generally, all available small buildings are constructed with a specific size (i.e., width, length, and height) and cannot be altered. Also, all commercially available small buildings are either constructed or assembled by the company that sells them or they are prefabricated in set pieces that are, in most instances, difficult for the purchaser to assemble. Further, if the small buildings are rugged they are relatively expensive and if they are inexpensive they do not last very well. These buildings cannot be altered at a later time to accommodate different or additional uses and any change or increase in size requires the purchase and assembly of a completely new building.

It would be highly advantageous, therefore, to remedy the foregoing and other deficiencies inherent in the prior art.

Accordingly, it is an object the present invention to provide a new and improved building system.

Another object of the present invention is to provide a new and improved building system that can be used to assemble small buildings for any of a large variety of purposes.

And another object of the present invention is to provide a new and improved building system which can be used to assemble small buildings that are easy and inexpensive to assemble, disassemble, alter in size, or otherwise modify.

Still another object of the present invention is to provide a new and improved building system which can be used to assemble small buildings that can easily be expanded or contracted in size for different uses and purposes.

Yet another object of the present invention is to provide a new and improved building system which can be used to assemble small buildings that are sturdy and can easily be assembled by the purchaser.

SUMMARY OF THE INVENTION

Briefly, to achieve the desired objects of the present invention in accordance with a preferred embodiment thereof, provided is a building system including an elongated sheet metal building element having a roof portion and two opposed sidewall portions extending longitudinally from opposite sides of the roof portion. The roof portion and sidewall portions of the building element are integrally formed and attached by bends in the sheet metal, and the roof portion and sidewall portions of the building element define a longitudinally and laterally extending flat surface between right-angle flanges extending along opposed edges of the roof portion and sidewall portions. The flanges are formed by bends in the sheet metal and include slots at the bends between the roof portion and sidewall portions.

The desired objects of the present invention are further realized in accordance with a preferred embodiment thereof wherein a building system is used that includes a plurality of elongated building elements each including a roof portion and two opposed sidewall portions extending longitudinally from opposite sides of the roof portion. The roof portion and sidewall portions of each building element are integrally formed and attached, and the roof portion and sidewall portions of each building element define a longitudinally and laterally extending flat surface between right-angle flanges extending along opposed edges of the roof portion and sidewall portions. Each of the plurality of elongated building elements is formed to be placed adjacent another of the plurality of elongated building elements with adjacent right-angle flanges abutting and fixedly engaged together at spaced apart points to form an extended roof and sidewalls.

In a more specific embodiment, a small building is assembled using a building system that includes a plurality of elongated building elements each having a roof portion and two opposed sidewall portions extending longitudinally from opposite sides of the roof portion. The roof portion and sidewall portions of each building element are integrally formed and attached, and the roof portion and sidewall portions of each building element define a longitudinally and laterally extending flat surface between right-angle flanges extending along opposed edges of the roof portion and sidewall portions. Each of the plurality of elongated building elements is placed adjacent another of the plurality of elongated building elements with adjacent right-angle flanges abutting and fixedly engaged together at spaced apart points to form an extended roof and sidewalls.

By changing the number of the plurality of elongated building elements used, the length of the building can be changed to any desired length. Further, additional building elements can be added or subtracted at any time during the life of the building. Also, by changing the length of the sidewall portions of the building elements, or the angle of the roof portion, the width and height of the building can be changed to any desired size.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which:

FIG. 1 is a side view of a small building, being used as a garage, in accordance with the present invention;

FIG. 2 is a partially exploded and enlarged overhead perspective view of the small building of FIG. 1, illustrating some of the assembly steps;

FIG. 3 is an enlarged view in cross-section of a sidewall of the small building of FIG. 1, portions thereof broken away;

FIG. 4 is a greatly enlarged perspective, interior view of a sidewall of the small building of FIG. 1, portions thereof broken away and, shown in section;

FIG. 5 is an overhead view in perspective of a garage with an end wall and over-head garage door in accordance with the present invention;

FIG. 6 is an overhead view in perspective of a carport or canopy type building in accordance with the present invention;

FIG. 7 is a side view of the carport or canopy type building of FIG. 6 illustrating expansion possibilities;

FIG. 8 is an enlarged exterior perspective view of a corner of a small building in accordance with the present invention, illustrating some assembly steps;

FIG. 11 is a side view of the upper end of a building element for a wall during manufacture;

FIG. 12 is a side view of the upper end of the building element illustrated in FIG. 11 after a final manufacturing step;

FIG. 13 is a view in perspective of the upper end of the building element illustrated in FIG. 9 with the step of FIG. 12 illustrated in broken lines;

FIG. 14 is a sectional view of the upper end of the building element illustrated in FIG. 12 attached to a building element used in the roof;

FIG. 15 is a cross-section of adjacent building elements forming a portion of a sidewall of the small building of FIG. 9;

FIG. 16 is an enlarged sectional view of adjacent sides of building elements;

DETAILED DESCRIPTION OF PREFERRED EMBODIMENTS

Figure 10:
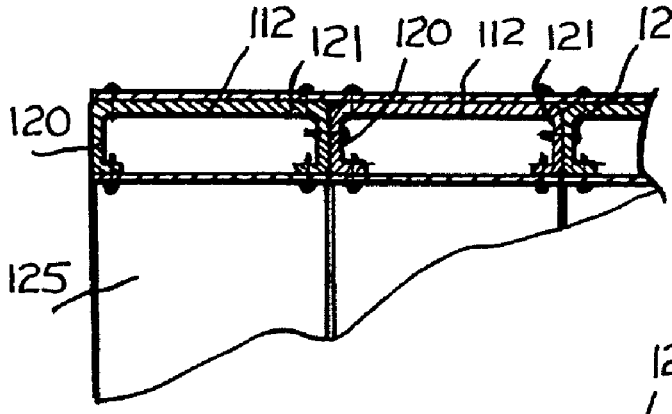
FIG. 10 is an enlarged sectional view of a portion of a wall of the structure of FIG. 9, adjacent a lower end.

Turning now to the drawings in which like reference characters indicate corresponding elements throughout the several views, attention is directed to FIG. 1, which illustrates a small building, in this specific example a garage 10, constructed in accordance with the present invention. Garage 10 is assembled using a building system including a plurality of elongated building elements 12 each including an elongated roof portion 14 and two opposed elongated sidewall portions 15 and 16 extending longitudinally from opposite ends of roof portion 14. Roof portion 14 and sidewall portions 15 and 16 are integrally formed and attached, in this preferred embodiment from a single piece of sheet metal. In a preferred embodiment the sheet metal used is a thin gauge sheet steel but other materials, such as aluminum could be used if desired.

Flanges 20 and 21 extend along opposed edges of roof portion 14 and sidewall portions 15 and 16 of elongated sheet metal building element 12. Flanges 20 and 21 are formed by right angle bends in the sheet metal and include slots 24 at the bends, for example, between roof portion 14 and sidewall portions 15 and 16. Roof portion 14 and sidewall portions 15 and 16 define a laterally extending flat surface between flanges 20 and 21. Flanges 20 and 21 operate as the studs in a standard wooden building and may have, for example, a width substantially equal to a wooden stud (e.g., approximately three and one-half inches). Also, in a preferred embodiment the distance between flanges 20 and 21, or the lateral extent of the flat surface, is approximately equal to a standard building distance between studs (i.e., a distance in a range of eighteen inches to twenty-one inches). By making the width and spacing of flanges 20 and 21 approximately equal to the width and spacing of studs in a wooden building, garage 10 can be easily adapted to standard items used in the building industry.

In this specific embodiment, roof portion 14 is constructed to define a peak with two sloping sides 26 and 27 extending longitudinally from the peak to opposed sidewall portions 15 and 16. Also, a slot 24 is formed in each of the flanges 20 and 21 at the bend between sloping sides 26 and 27. It should be understood, however, that roof portion 14 could be designed to form a single sloping or flat side and a single sidewall portion (e.g., sidewall portion 15 or 16) could extend from either end. Also, the height of garage 10 can be changed by changing the angle of the bends at the junctures of roof portion 14 and sidewall portions 15 and 16 and/or the bend at the peak of roof portion 14. Further, the height of garage 10 can be changed by altering the length of sidewall portions 15 and 16.

To construct garage 10 a plurality of building elements 12 are provided. Also, in the preferred embodiment, two elongated channel elements 30 and 31 are provided. Each channel element 30 and 31 defines a channel with a width slightly larger than the width of right-angel flanges 20 and 21. Channel elements 30 and 31 are positioned on a mounting surface, such as a cement footing or the ground, with the channels opening upwardly, as illustrated in FIG. 2. A first building element 12 is selected and the lower end of sidewall 15 is positioned in the channel of channel element 30 and the lower end of sidewall 16 is positioned in the channel of channel element 31. By drilling holes (if not provided) and inserting self-tapping sheet metal screws the lower ends of the opposed sidewall portions 15 and 16 are fixedly engaged in the channels of channel elements 30 and 31. Generally, appropriate assembly holes will be provided in building elements 12 by the manufacturer.

A second building element 12 is selected and positioned with the lower ends of sidewall portions 15 and 16 in the channels of channel elements 30 and 31, respectively. The second building element 12 is moved so that flange 21 of the second building element 12 buts against flange 20 of the first building element. Holes can then be drilled (if not provided) and self-tapping sheet metal screws are used to fixedly engage the second building element 12 to the first building element 12, as best illustrated in FIGS. 3 and 4, and in the channels of channel elements 30 and 31. Additional building elements 12 are added in a similar fashion to extend garage 10 the desired length. In this fashion roof portions 14 form an extended roof and sidewall portions 15 and 16 form extended sidewalls.

As can best be seen in FIG. 1, decorative roof materials, such as tiles 35 can be affixed to an upper surface of the extended roof and in a similar fashion decorative siding materials can be affixed to the extended sidewalls if desired.

End-walls, as best seen in FIG. 5, can be formed in garage 10 if desired by providing a plurality of end-wall portions 35. Each end-wall portion 35 defines a longitudinally and laterally extending flat surface between right-angle flanges extending along opposed edges, similar to sidewall portions 15 or 16. The upper end of each end-wall portion 35 is cut at an angle to match the angle of roof portion 14 and the length varies according to the position in the end wall. End-wall portions 35 are assembled as described in conjunction with building elements 12 and a channel element (e.g., similar to channel elements 30 or 31) can be used at the lower end if desired. It will of course be understood that the length and angle of end-wall portions 35 depends upon the height of garage 10 and the type or shape of roof formed. For example, if a flat roof is formed end-wall portions 35 will all be rectangular and have the same length.

The outer-most end-wall portions 35 on each side of the end-wall are attached to flanges 20 and 21 of sidewall portions 15 and 16, respectively, either by butting the outer-most flange of end-wall portions 35 against the inner flat surface of a selected sidewall portion 15 and 16 or by butting the outer-most flange against flanges 20 and 21 of sidewall portions 15 and 16. In either case self-tapping metal screws are used to hold the end-wall fixedly in place.

If desired one or more openings can be provided in the end-wall and a door and/or windows can be mounted in the opening or openings using standard building techniques. As illustrated in FIG. 5, an opening is provided and an overhead garage door is affixed in the opening.

Turning now to FIGS. 6 and 7, a carport or canopy 50 is illustrated, which is constructed in accordance with the present invention. Canopy 50 is assembled using a building system including a plurality of elongated building elements 52 each including an elongated roof portion 54 and two opposed elongated sidewall portions 55 and 56 extending longitudinally from opposite ends of roof portion 54. Roof portion 54 and sidewall portions 55 and 56 are integrally formed and attached, in this preferred embodiment from a single piece of sheet metal.

Right-angle flanges 60 and 61 extend along opposed edges of roof portion 54 and sidewall portions 55 and 56 of elongated sheet metal building element 52. Flanges 60 and 61 are formed by bends in the sheet metal and include slots 64 at the bends, for example, between roof portion 54 and sidewall portions 55 and 56. Roof portion 54 and sidewall portions 55 and 56 define a laterally extending flat surface between flanges 60 and 61. In this specific embodiment, roof portion 54 is constructed to define a peak with two sloping sides 66 and 67 extending longitudinally from the peak to opposed sidewall portions 55 and 56. Also, a slot 64 is formed in each of the flanges 60 and 61 at the bend between sloping sides 66 and 67. It should be understood, however, that roof portion 54 could be designed to form a single sloping or flat side and a single sidewall portion (e.g., sidewall portion 55 or 56) could extend from either end.

In a preferred embodiment, the lower ends of sidewall portions 55 and 56 are fixed in a channel element 70 and 71, respectively. Channel elements 70 and 71 are similar to channel elements 30 and 31, described above, and the manner of fixing the lower ends of sidewall portions 55 and 56 in the channels is similar. Channel elements 70 and 71 are then positioned at a desired height above the ground, or other supporting or mounting surface, by means of posts 75. Generally, canopy 50 will have at least a post 75 supporting each corner and, depending upon the length, may have additional intermediate posts 75 positioned along the sides. Posts 75 are generally supported on feet 76 which may be positioned directly on the ground or on cement footings or the like. As portrayed in FIG. 7, the length of canopy 50 is determined by the number of building elements 52 used and can be altered at any time simply by adding or subtracting building elements 52.

Referring additionally to FIG. 8, the over-all strength or rigidity of the small building (e.g., garage 10 or canopy 50) can be increased, if desired, by providing and attaching angled flat elements 80 thereto. Element 80 is formed to be affixed in abutting engagement with one of the flanges (flanges 20 and/or 21 of element 12 and flanges 60 and/or 61 of element 52) and to extend across the slot (24 or 64) between the roof portion and the sidewall portion for providing additional support. Generally, angled flat elements 80 can be conveniently formed from a thin sheet of rigid metal, such as steel or the like, and can be approximately the same width as the associated flange. Also, the angle of angled flat elements 80 can be approximately the same as the angle between the portions being bridged. Further, angled flat elements 80 can be used to bridge all of the slots in the small building if that amount of rigidity is desired or they can be used to bridge only specific slots, such as those in the outer-most single flanges (see FIG. 8).

Figure 9:
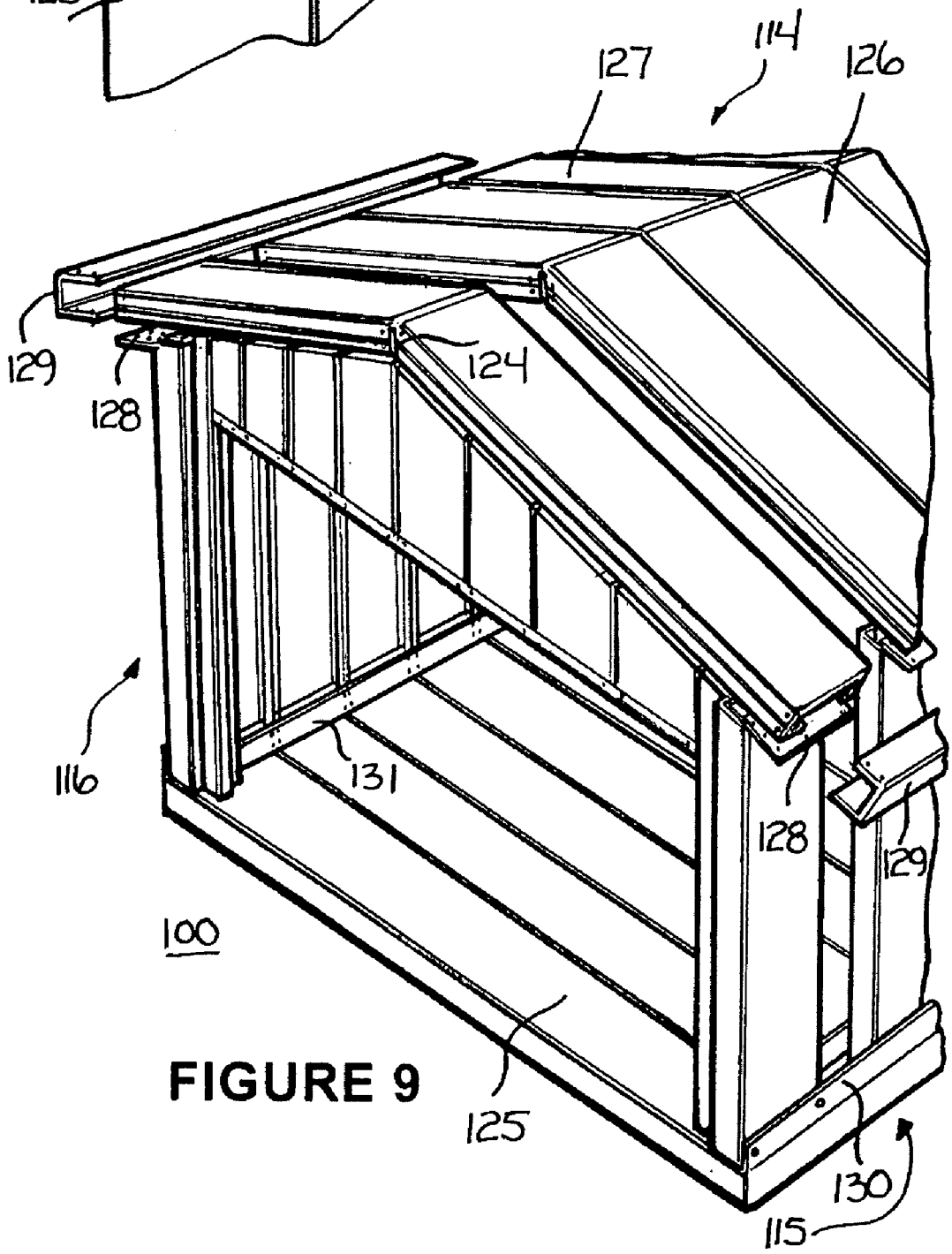
FIG. 9 is an overhead view in perspective of another embodiment of a small building with an end wall and over-head door in accordance with the present invention.

Turning now to FIG. 9, another embodiment of a small building 100, such as a garage or the like, is illustrated. In this embodiment, elongated building elements 112 are used to form a roof 114 and two opposed sidewalls 115 and 116 extending downwardly from adjacent opposite ends of roof 114. Referring additionally to FIG. 10, it can be seen that in this embodiment each of the building elements 112 include flanges 120 and 121 extending along opposed edges of elongated sheet metal building elements 112. Flanges 120 and 121 each include a first right angle bend and a second right angle bend to form an end of the flange parallel and spaced from the main body of the building element. Each of the building elements 112 defines a laterally extending flat surface between flanges 120 and 121.

Flanges 120 and 121 operate as the studs in a standard wooden building and may have, for example, a width substantially equal to a wooden stud (e.g., approximately three and one-half inches). Also, in a preferred embodiment the distance between flanges 120 and 121, or the lateral extent of the flat surface, is approximately equal to a standard building distance between studs (i.e., a distance in a range of eighteen inches to twenty-one inches). By making the width and spacing of flanges 120 and 121 approximately equal to the width and spacing of studs in a wooden building, small building 100 can be easily adapted to standard items used in the building industry.

To construct garage 100 a plurality of building elements 112 are provided for roof 114 and sidewalls 115 and 116. Also, in the preferred embodiment, two elongated channel elements 130 and 131 are provided. Each channel element 130 and 131 defines a channel with a width slightly larger than the width of flanges 120 and 121. Channel elements 130 and 131 are positioned on a mounting surface, such as a building floor 125, a cement footing, or the ground, with the channels opening upwardly, as illustrated in FIG. 10. Here it should be noted that floor 125 can be formed of building elements 112 also, if desired.

A first building element 112 is selected and the lower end is positioned in the channel of channel element 130. A second building element 112 is selected and positioned with the lower end in the channel of channel element 30. The second building element 112 is moved so that flange 120 of the second building element 112 buts against flange 121 of the first building element. Holes can then be drilled (if not provided) and self-tapping sheet metal screws are used to fixedly engage the second building element 112 to the first building element 112, as best illustrated in FIG. 10, and in the channels of channel element 130. Generally, appropriate assembly holes will be provided in building elements 112 by the manufacturer. Additional building elements 112 are added in a similar fashion to complete sidewall 115 and to extend small building 100 the desired length. In a similar fashion sidewall 116 is assembled in channel 131.

In this specific embodiment, roof 114 is constructed of a plurality of building elements 112 formed to define a peak with two sloping sides 126 and 127 extending longitudinally from the peak to opposed sidewalls 115 and 116. Also, a slot 124 is formed in each of the flanges 120 and 121 at the bend between sloping sides 126 and 127 of the building elements 112 forming roof 114. It should be understood, however, that roof 114 could be designed to form a single sloping or flat side, if desired. Also, a single sidewall (e.g., sidewall 115 or 116) could extend from adjacent either end. Also, the height of garage 100 can be changed by changing the height of sidewalls 115 and 116 and/or the bend at the peak of roof 114.

Roof 114 is attached to sidewalls 115 and 116 by performing some additional steps on the upper ends of the building elements 112 forming sidewalls 115 and 116, as can be seen by referring additionally to FIGS. 11 through 14. In a preferred embodiment the sheet metal used in building elements 112 is a thin gauge sheet steel but other materials, such as aluminum could be used if desired. As seen in FIGS. 11 and 13, flanges 120 and 121 are removed from the upper edges of each building element 112 used in sidewalls 115 and 116 leaving a portion 128 of the laterally extending flat surface. Generally the length of flanges 120 and 121 removed will be such that the length of portion 128 is approximately equal to the amount of soffit desired for small building 100, as can best be seen in FIG. 14. Portion 128 is then bent at an angle (see FIG. 12) to the longitudinal axis of building element 112.

Portion 128 mates with flanges 120 and 121 of an overlying building element 112 of roof 114, as best seen in FIG. 14. Holes can then be drilled (if not provided) and self-tapping sheet metal screws are used to fixedly engage portion 128 of the building element 112 of sidewall 115 to flanges 120 and 121 of the overlying building element 112 of roof 114. In a similar fashion the upper ends of building elements 112 forming sidewall 116 are formed and attached to the opposite ends of the building elements 112 of roof 114. Thus, roof 114 is firmly attached to sidewalls 115 and 116 and the soffits are substantially enclosed. To finish roof 114 channel elements 129 are affixed over the ends of building elements 112 forming roof 114 to substantially completely enclose the ends of roof 114. To affix channel elements 129, holes can be drilled (if not provided) and self-tapping sheet metal screws are used to fixedly engage channel elements 129 to the flanges 120 and 121 and to the upper surface of the building elements 112 of roof 114.

Also in another embodiment, the flanges formed in the building elements can be slightly indented, as illustrated in FIGS. 15 and 16, to provide a more secure fit. In this embodiment similar components are designated with a similar number and a prime is added to indicate the different embodiment. To form each building element 112' flanges 120' and 121' are formed along each edge, respectively, as described above. Also, an elongated wrinkle or crease 132' is formed adjacent one side so as to extend the length of building element 112. Similarly, a second wrinkle or crease 133' is formed adjacent the opposite side so as to extend the length of building element 112. Creases 132' and 133' are formed to project outwardly (form a ridge) from one surface and to project inwardly (form a groove) in the opposite surface. Further, creases 132' and 133' are positioned approximately centrally in the side portion of flanges 132' and 133' and are formed in the material so as to be directed in opposite directions. Generally, for convenience in manufacture, creases 132' and 133' will be formed prior to the formation of flanges 120' and 121'.

Thus, as illustrated best in FIG. 16, when two building elements 112' are positioned side-by-side in abutting engagement, crease 132' of one building element 112' is nestled into crease 133' of the adjacent building element 112'. The nestling of the oppositely directed creases between adjacent building elements effectively closes any passage for the movement of dirt or other foreign materials into the building.

Figure 19:
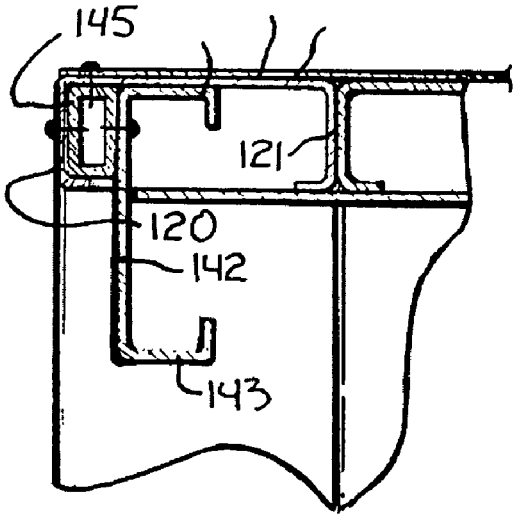
FIG. 19 is a sectional view of another corner building element adjacent the bottom end.
Figure 18:
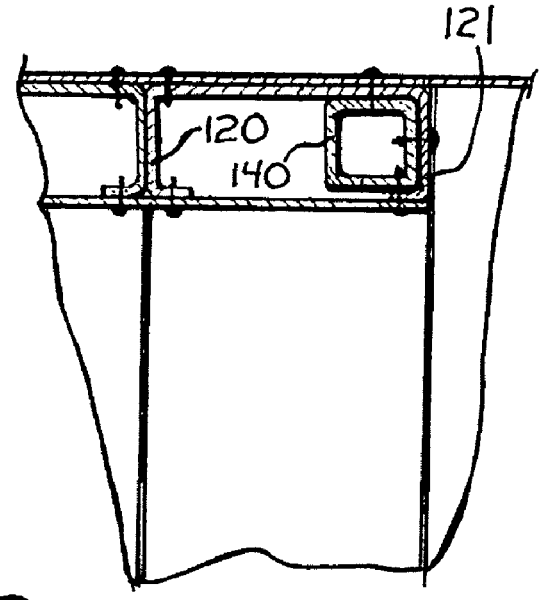
FIG. 18 is a sectional view of a corner building element adjacent the bottom end.
Figure 17:
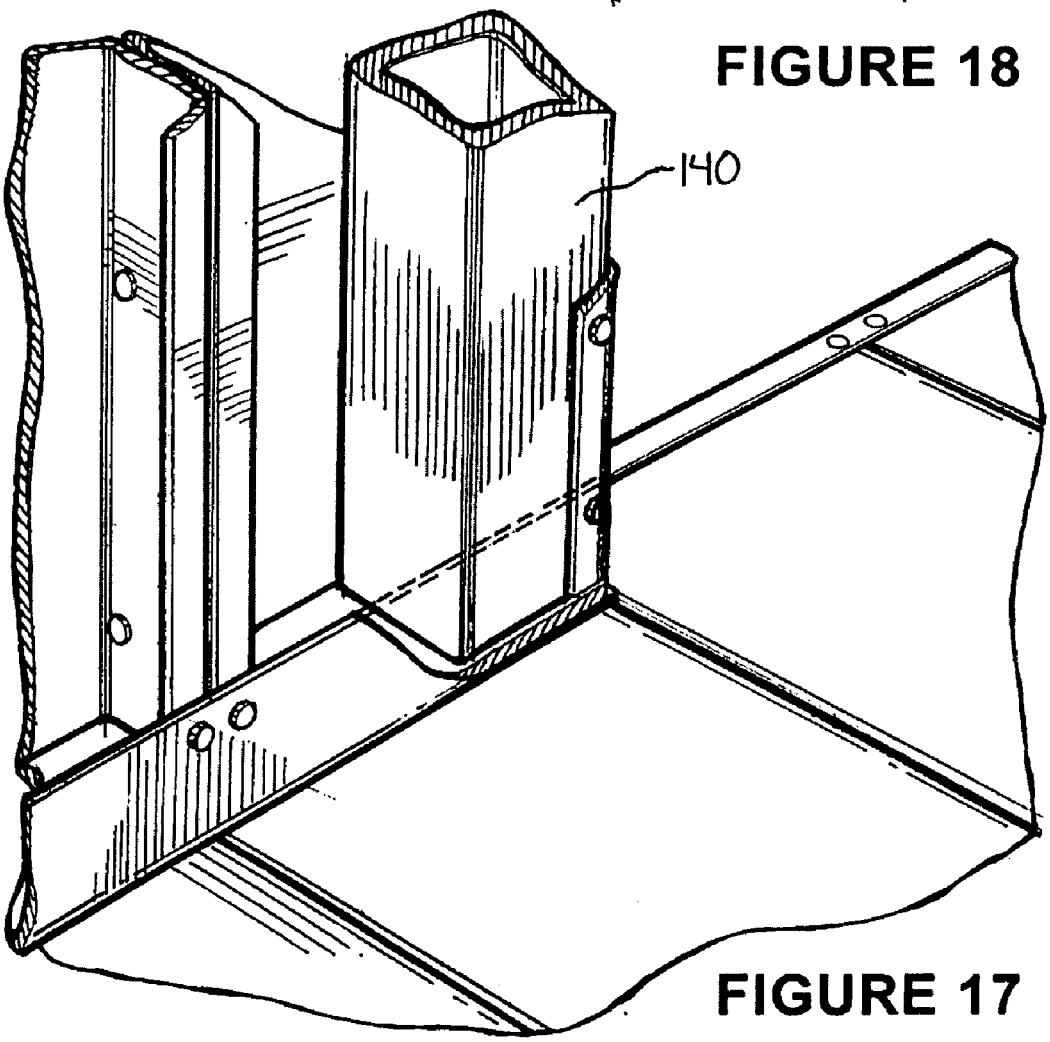
FIG. 17 is an enlarged view in perspective of an upper corner of the small building of FIG. 9, portions thereof broken away and shown in section.

Turning now to FIGS. 17, 18 and 19, some additional elements for forming openings, such as door or window casings, are illustrated. One such element is a tubular element 140 having a substantially square cross-section and sized to be nestingly positioned within one of the flanges 120 or 121 of a building element 112. In FIG. 18, for example, element 140 is positioned within flange 121 so that flange 121 extends around and in abutting engagement with sides of element 140. To affix element 140 to building element 112, holes can be drilled (if not provided) and self-tapping sheet metal screws are used to fixedly engage element 140 to flange 121. Thus, element 140 forms a very ridged corner or side for the addition of a door or window or just for additional support of the building.

Referring to FIG. 19, an element 142 is constructed with flanges 143 and 144 substantially similar to building elements 112 but may have a narrower transverse direction than building elements 112. Element 142 is positioned generally perpendicular to a building element 112 in a side wall so that one side of flange 144 buts against the inside surface of building element 112. In this embodiment, to add additional strength to the structure, a small tubular element 145, with a generally rectangular cross-section, is nested in flange 120 of building element 112 and element 142 is positioned in abutting engagement with the exposed surface of element 145. To affix element 142 to building element 112 and element 145, holes can be drilled (if not provided) and self-tapping sheet metal screws are used to affix one surface of flange 144 of element 142 to the inner surface of building element 112 and to affix the outer surface of element 142 to the exposed surface of element 145. Thus, the opening between flanges 143 and 144 of element 142 is used as a track for a sliding door, for example.

In the embodiments illustrated in FIGS. 9 through 19, one standardized building element can be used to form side walls, roof, floor doors, etc. The standardized building elements can be modified, either by the factory or by an individual, to be positioned in the roof or to form the side walls. Also, the standardized elements can be cut to different lengths to form different portions of a building or to form different sized buildings.

Thus, a new and improved building system is disclosed that can be used to assemble small buildings for any of a large variety of purposes, such as completely or partially enclosed garages for single cars or other vehicles, carports or canopies, storage sheds and the like. The new and improved building system can be used to assemble small buildings that are easy and inexpensive to assemble, disassemble, alter in size, or otherwise modify. Also, the new and improved building system can be used to assemble small buildings that can easily be expanded or contracted in size for different uses and purposes and that are sturdy and can easily be assembled by the purchaser.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A building system comprising:

a plurality of elongated sheet metal building elements, each building element including a central elongated flat portion with an integral flange extending along each longitudinal edge, and each integral flange including a first right-angle bent portion perpendicular to the flat portion and a second right-angle bent portion parallel and spaced from the flat portion;

a first group of the plurality of elongated sheet metal building elements being connected together by adjacent flanges to form two opposed upwardly extending sidewalls;

a second group of the plurality of elongated sheet metal building elements being connected together by adjacent flanges to form a roof;

each of the first group of the plurality of elongated sheet metal building elements forming the sidewalls includes a length of the central elongated flat portion adjacent an upper end without flanges to form an extension, the extension formed by the length of the central elongated flat portion being bent parallel to the roof and connected to flanges of the second group of the plurality of elongated sheet metal building elements forming the roof to connect the roof to the sidewalls; and the roof being connected to the sidewalls by extensions of the sidewalls.

2. A building system as claimed in claim 1 wherein each of the plurality of elongated sheet metal building elements extends laterally a distance in a range of eighteen inches to twenty-one inches.

3. A building system as claimed in claim 1 wherein the roof defines a peak with two sloping sides extending longitudinally from the peak to the opposed sidewalls.

4. A building system as claimed in claim 1 including channel elements affixed over exposed ends of the second group of the plurality of elongated sheet metal building elements connected together to form the roof.

5. A building system as claimed in claim 1 wherein each of the first right-angle bent portions of each integral flange of each of the plurality of elongated sheet metal building elements includes a longitudinally extending crease positioned and formed to nestingly engage a crease in an adjacent elongated sheet metal building element.

6. A small building comprising:

a building system including a plurality of elongated building elements each having an elongated roof portion and two opposed elongated sidewall portions extending longitudinally from opposite ends of the roof portion, the roof portion and sidewall portions of each building element being integrally formed and attached, and the roof portion and sidewall portions of each building element defining a longitudinally and laterally extending flat surface between flanges extending along opposed edges of the roof portion and sidewall portions;

the roof portion of each of the plurality of elongated building elements defines a peak with two sloping sides extending longitudinally from the peak to the opposed sidewall portions; and each of the plurality of elongated building elements being placed adjacent another of the plurality of elongated building elements with adjacent flanges abutting and fixedly engaged together at spaced apart points to form an extended roof and sidewalls.

7. A small building as claimed in claim 6 wherein the flat surface defined by each of the plurality of elongated building elements extends laterally, between the flanges, a standard building distance between studs.

8. A small building as claimed in claim 7 wherein the flat surface of each of the plurality of elongated building elements extends laterally a distance in a range of eighteen inches to twenty-one inches.

9. A small building as claimed in claim 6 including at least one angled flat element associated with each of the plurality of elongated building elements and formed to be affixed in abutting engagement with one of the flanges of the associated building element and to extend across the slot between the roof portion and one of the sidewall portions for providing additional support.

10. A small building as claimed in claim 6 wherein the sidewall portions of each of the plurality of elongated building elements extend from the roof portion to a mounting surface to form complete sidewalls on opposed sides of the small building.

11. A small building as claimed in claim 10 further including two elongated channel elements each defining a channel with a width larger than the flanges, the channel elements being positioned on the mounting surface with the channels opening upwardly and lower ends of the opposed complete sidewalls being fixedly engaged, one each, in the channels of the channel elements.

12. A small building as claimed in claim 6 further including a plurality of elongated end-wall portions, each of the plurality of end-wall portions defining a longitudinally and laterally extending flat surface between flanges extending along opposed edges of end-wall portions, and each of the plurality of end-wall portions being placed adjacent another of the plurality of end-wall portions with adjacent flanges abutting and fixedly engaged together at spaced apart points to form an extended end-wall, and flanges at outer edges of the extended end-wall being affixed to abutting flanges in opposed sidewalls to affix the extended end-wall in the small building.

13. A small building as claimed in claim 12 further including a door opening defined in the extended end-wall.

14. A small building as claimed in claim 13 further including a door affixed in the opening defined in the extended end-wall.

15. A small building as claimed in claim 14 wherein the door affixed in the opening defined in the extended end-wall is an overhead garage door.

16. A small building as claimed in claim 6 further including decorative roof materials affixed to an upper surface of the extended roof.

17. A small building comprising:

a building system including a plurality of elongated building elements each having an elongated roof portion and two opposed elongated sidewall portions extending longitudinally from opposite ends of the roof portion, the roof portion and sidewall portions of each building element being integrally formed and attached, and the roof portion and sidewall portions of each building element defining a longitudinally and laterally extending flat surface between flanges extending along opposed edges of the roof portion and sidewall portions;

the sidewall portions of each of the plurality of elongated building elements extend partially from the roof portion to a mounting surface and the plurality of elongated building elements are supported by posts extending from the sidewall portions to the mounting surface;

each of the plurality of elongated building elements being placed adjacent another of the plurality of elongated building elements with adjacent flanges abutting and fixedly engaged together at spaced apart points to form an extended roof and sidewalls.

* * * * *